US008020961B2

(12) United States Patent
Watanabe et al.

(10) Patent No.: US 8,020,961 B2
(45) Date of Patent: Sep. 20, 2011

(54) INK-JET RECORDING APPARATUS

(75) Inventors: Hidetoshi Watanabe, Tokoname (JP); Atsuo Sakaida, Gifu (JP)

(73) Assignee: Brother Kogyo Kabushiki, Nagoya-shi, Aichi-ken (JP)

( * ) Notice: Subject to any disclaimer, the term of this patent is extended or adjusted under 35 U.S.C. 154(b) by 876 days.

(21) Appl. No.: 11/748,685

(22) Filed: May 15, 2007

(65) Prior Publication Data

US 2007/0263059 A1 Nov. 15, 2007

(30) Foreign Application Priority Data

May 15, 2006 (JP) ..... 2006-134759

(51) Int. Cl.
*B41J 2/015* (2006.01)

(52) U.S. Cl. ..... 347/20; 347/21

(58) Field of Classification Search ..... 347/20, 347/68, 21

See application file for complete search history.

(56) References Cited

U.S. PATENT DOCUMENTS

| | | | | |
|---|---|---|---|---|
| 5,557,307 | A * | 9/1996 | Paroff | 347/34 |
| 6,491,364 | B2 * | 12/2002 | Webster et al. | 347/21 |
| 7,213,911 | B2 | 5/2007 | Taira | |
| 7,384,132 | B2 | 6/2008 | Ito | |
| 2005/0083379 | A1 | 4/2005 | Chikamoto | |
| 2005/0156998 | A1 * | 7/2005 | Silverbrook | 347/34 |
| 2006/0227174 | A1 * | 10/2006 | Taira | 347/54 |
| 2007/0229607 | A1 * | 10/2007 | Taira et al. | 347/71 |

FOREIGN PATENT DOCUMENTS

| | | | |
|---|---|---|---|
| JP | H08-187842 A | | 7/1996 |
| JP | 2003-165230 A | | 6/2003 |
| JP | 2003165230 A | * | 6/2003 |
| JP | 2005-017840 A | | 1/2005 |
| JP | 2005-022129 A | | 1/2005 |
| JP | 2005-059438 A | | 3/2005 |
| JP | 2005-246903 A | | 9/2005 |
| JP | 2006-062097 A | | 3/2006 |
| JP | 2006082395 A | | 3/2006 |

OTHER PUBLICATIONS

Japanese Patent Office, Notice of Ground for Rejection in Japanese Patent Appln No. 2006-134759 (counterpart to the above-captioned U.S. patent application) mailed May 20, 2008.

Japan Patent Office, Notice of Decision of Final Rejection of Japanese Patent Application No. 2006-134759 (counterpart to above-captioned U.S. patent application) mailing date Sep. 16, 2008.

* cited by examiner

*Primary Examiner* — Julian D Huffman
*Assistant Examiner* — Jason S Uhlenhake
(74) *Attorney, Agent, or Firm* — Baker Botts L.L.P.

(57) ABSTRACT

An ink-jet recording apparatus includes an ink-jet head formed with an ejection face, and an ejection control board fixed to the ink-jet head. A head cover forms a container space that contains therein the ejection control board. The container space has an air inflow port and an air outflow port. An airflow generator generates an airflow that goes into the container space through the inflow port and out of the container space through the outflow port. Through the outflow port, an airflow filtered by the filter goes out of the container space across a plane including the ejection face.

15 Claims, 11 Drawing Sheets

INK-JET RECORDING APPARATUS

CROSS-REFERENCE TO RELATED APPLICATION

This application claims the benefit of Japanese Patent Application No. 2006-134759, filed May 15, 2006, the disclosure of which is incorporated herein by reference.

BACKGROUND OF THE INVENTION

1. Field of the Invention

The present invention relates to an ink-jet recording apparatus, and particularly to an ink-jet recording apparatus having a cover for an ink-jet head.

2. Description of the Related Art

Some ink-jet recording apparatus is provided with a head cover that covers at least a part of an ink-jet head for the purpose of protecting and fixing the ink-jet head. Japanese Unexamined Patent Publication No. 2006-82395 discloses an example of such an ink-jet head having the head cover.

An ejection face, which is a lower face of an ink-jet head, is formed thereon with ejection ports that eject ink. Ink is ejected from the ejection ports toward a printing paper so that an image is formed on the printing paper. Therefore, the lower face of the ink-jet head having the ejection ports formed thereon faces the printing paper on which an ink droplet lands.

SUMMARY OF THE INVENTION

A printing paper on which an ink droplet will land is conveyed to a position opposed to an ejection face of a head, sometimes under a state where a foreign material such as paper dust, which has been generated in a preparation step including cutting the paper, still remains on the paper. In such a case, if the foreign material flies up from the printing paper due to some factor such as movement of the printing paper or an airflow generated in an apparatus, ejection ports may be partially or fully closed with the foreign material. Since the foreign material obstructs ink ejection, an image may be formed on the printing paper undesirably with reduced reproducibility.

An object of the present invention is to provide an ink-jet recording apparatus that is able to suppress reduction in reproducibility of an image formed on a printing paper, which may otherwise be caused by a foreign material adhering to the printing paper.

According to an aspect of the present invention, there is provided an ink-jet recording apparatus including an ink-jet head, an ejection control board, a head cover, an inflow port, an outflow port, a filter, and an airflow generator. The ink-jet head has an ejection face on which an ejection port that ejects ink is formed, a side face extending along a direction crossing the ejection face, and an ejection energy applier that applies ejection energy to ink thereby making ink ejected from the ejection port. The ejection control board is fixed to the ink-jet head and electrically connected to the ejection energy applier. The head cover is fixed to the ink-jet head so as to expose out the ejection face, and forms a container space that contains therein the ejection control board. Through the inflow port, air passes into the container space. Through the outflow port, air passes out of the container space. The filter filters air. The airflow generator that generates an airflow going into the container space through the inflow port and out of the container space through the outflow port. Through the outflow port, an airflow filtered by the filter goes out of the container space across a plane including the ejection face.

In the ink-jet recording apparatus according to the present invention, the airflow goes out of the container space through the outflow port across the plane including the ejection face. Therefore, a foreign material that is flying up from a printing paper cannot easily approach the ejection face. Thus, adhering of the foreign material to the ejection face can be suppressed. This less often causes the ejection port to be partially or fully closed with the foreign material. As a result, an image can be formed on the printing paper with excellent reproducibility. In addition, an airflow having flown out through the outflow port does not include a foreign material, because it was filtered by the filter. This can prevent a foreign material from adhering to the ejection face due to an airflow flowing out of the outflow ports. Moreover, the outflow port, through which an airflow flows out of the container space formed by the head cover, is provided relatively near the ejection face. This makes it more difficult that a foreign material adheres to the ejection face, than when an airflow flows outside the head cover. Further, the ejection control board is contained within the container space formed by the head cover. Accordingly, by an airflow, heat generated in the ejection control board can be easily taken away and discharged out of the container space. Still further, air having flown out through the outflow port blows against a printing paper that is opposed to the ejection face. As a result, the printing paper can be prevented from flying up.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

First Embodiment

Figure 1:
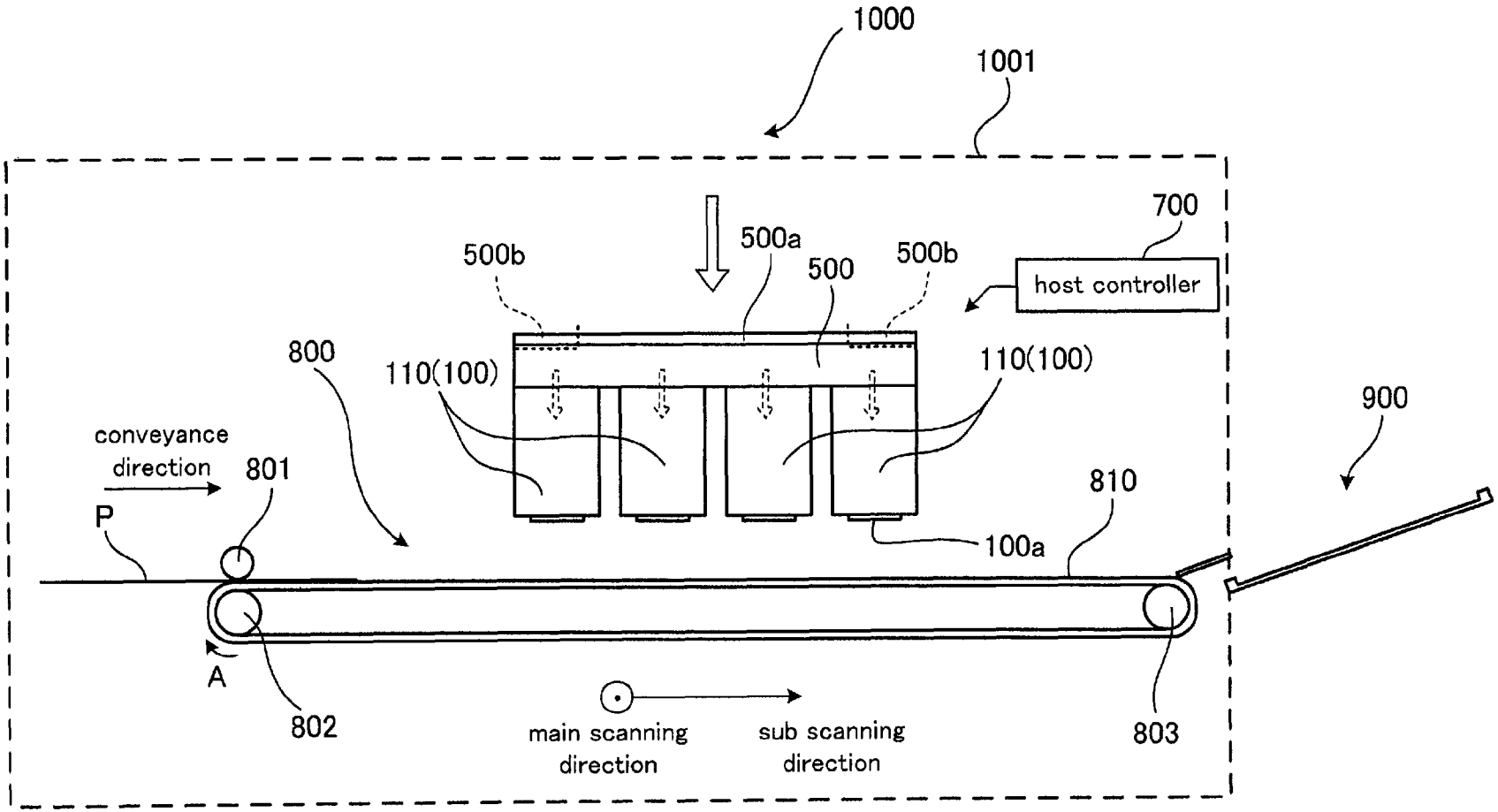
FIG. 1 is a side view showing a schematic construction of an ink-jet recording apparatus according to an embodiment of the present invention.

FIG. 1 is a side view showing a schematic construction of an ink-jet recording apparatus 1000 according to a first embodiment of the present invention. The ink-jet recording apparatus 1000 has a main body housing 1001. Placed within the main body housing 1001 are ink-jet heads 100, an air supply unit 500, a host controller 700, and a paper conveyor unit 800. A paper discharge tray 900 is provided outside the main body housing 1001.

The paper conveyor unit 800 has a feedout roller 801, a conveyor belt 810, and two belt rollers 802 and 803. The belt rollers 802 and 803 are disposed at a distance with respect to a horizontal direction. Both of the belt rollers 802 and 803 have their rotation axes extending in parallel with a main scanning direction. The belt roller 802, which is a drive roller driven by a not-shown motor, rotates in an arrow-A direction in FIG. 1. The belt roller 803 followingly rotates in the same direction as the rotation direction of the belt roller 802. Herein, a main scanning direction means a direction parallel to a horizontal plane and perpendicular to a conveyance direction of a printing paper, while a sub scanning direction means the same direction as the conveyance direction of a printing paper. In addition, terms "up" and "down" mean up and down along a drawing sheet of FIG. 1.

The conveyor belt 810 is an endless belt that is wound around the belt roller 802 and the belt roller 803. The conveyor belt 810 travels clockwise in FIG. 1 along with rotation of the belt roller 802. The conveyor belt 810 defines two upper and lower planes, of which the upper plane serves as a conveyor face for a printing paper.

The feedout roller 801 is disposed in a rotatable manner above the belt roller 802, with its rotation axis extending along the main scanning direction. A not-shown biasing means biases the feedout roller 801 toward the belt roller 802 with the conveyor belt 810 interposed therebetween. When the belt roller 802 rotates to make the conveyor belt 810 travel clockwise, the feedout roller 801 rotates counterclockwise due to rotational force given from the conveyor belt 810.

The paper discharge tray 900 in which printed papers are stacked is disposed most downstream with respect to a conveyance direction of the printing paper performed by the paper conveyor unit 800.

Four ink-jet heads 100 are placed above the paper conveyor unit 800. The four ink-jet heads 100 are arranged in a row along the conveyance direction. Many ejection ports 8 (see FIG. 7) are formed on an ejection face 100*a* that is provided on a lower face of each ink-jet head 100. The ejection face 100*a* faces the conveyor face of the conveyor belt 810. Different ink-jet heads 100 eject ink of different colors, from the ejection ports 8 formed on their ejection faces 100*a*. For example, the four ink-jet heads 100 eject black ink, cyan ink, yellow ink, and magenta ink, respectively. Each ink-jet head 100 is covered with a head cover 110. The head cover 110 has a substantially rectangular parallelepiped shape in which a cavity is formed. The cavity opens on an entire lower face of the head cover.

The ink-jet recording apparatus 1000 has a not-shown Central Processing Unit (CPU), a storage device including a memory, and an Input/Output (I/O) interface. A program used for controlling the ink-jet recording apparatus 1000 is stored in the storage device. The host controller 700 is constructed of a collaboration of the above-mentioned hardware of the ink-jet recording apparatus 1000 and software including the program stored in the storage device. While the ink-jet recording apparatus 1000 is connected to a personal computer through the I/O interface, the personal computer sends image data to the ink-jet recording apparatus 1000. Based on the image data sent from the personal computer, the host controller 700 controls ejection of ink from the ink-jet heads 100 and conveyance of a printing paper by the paper conveyance unit 800, in such a manner that an image corresponding to the image data is printed on the printing paper.

In the ink-jet recording apparatus 1000, an image is formed on a printing paper in the following manner. First, a printing paper P conveyed out of a not-shown paper supply unit reaches the feedout roller 801. The printing paper P thus having reached the feedout roller 801 moves in the conveyance direction along with movement of the conveyor belt 810 while being sandwiched between the feedout roller 801 and the conveyor belt 810. The printing paper P passes through the feedout roller 801, and then moves further rightward while being kept on the conveyor face of the conveyor belt 810.

When the printing paper P reaches a position opposed to the ejection faces 100*a* of the ink-jet heads 100, the ink-jet heads 100 start ejecting ink. By ejecting ink from the ink-jet heads while the printing paper P is being conveyed, an image is formed on the printing paper P.

The air supply unit 500, which is an airflow generator, is placed above the four ink-jet heads 100. An air intake 500*a* is provided on an upper face of the air supply unit 500. Not-shown air outlets are provided on a lower face of the air supply unit 500. Each of the air outlets is for each of the four head covers 110. The air outlets communicate with air intakes 151 (see FIG. 2) which will be described later. The air intakes 151 are provided on upper faces of the respective head cover 110. An air supply fan is disposed within the air supply unit 500. As the air supply fan rotates, air is taken through the air inlet 500*a* into the air supply unit 500 and then flows through the air intakes 151 into the ink-jet heads 100. White arrows shown in FIG. 1 indicate a flow of this air.

An ionizer 500*b*, which is a charged particle generator that ionizes particles contained in the air, is disposed within the air supply unit 500. The ionizer 500*b* ionizes a particle, such as a water molecule contained in the air, through corona discharge generated by application of high voltage to the air for example. By rotating the air supply fan and at the same time driving the ionizer 500*b*, an ionized molecule is included into air which will be sent into the head cover 110 by the air supply unit 500.

Although the air supply unit 500 generates an airflow by means of rotation of the air supply fan placed therein, other constructions may be adopted as the airflow generator as long as it generates an airflow to thereby make air flow through the air intakes 151.

The host controller 700 controls driving of the air supply unit 500. For example, the host controller 700 rotates the air supply fan while driving the ionizer 500*b* at a predetermined timing.

[Ink-Jet Head]

Figure 2:
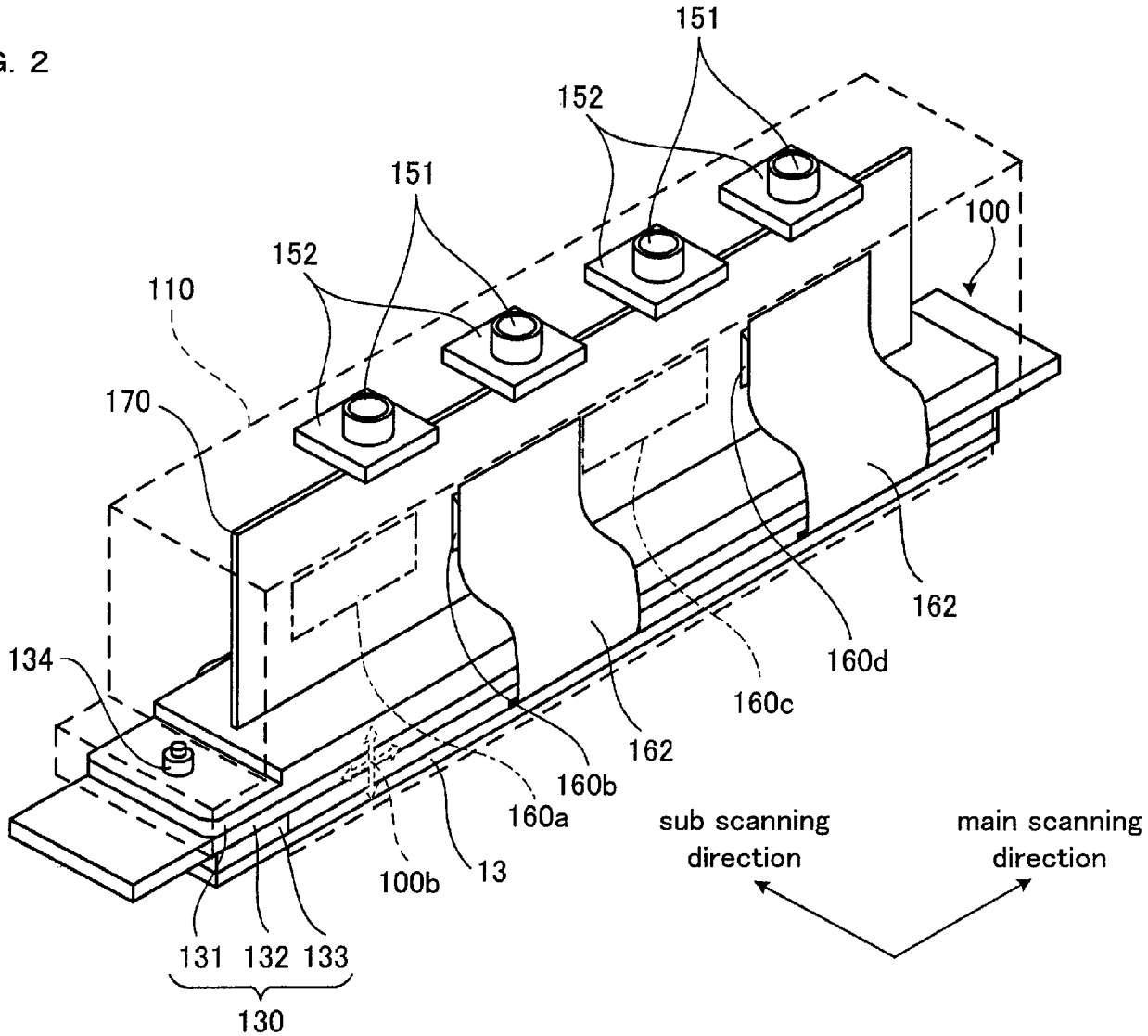
FIG. 2 is a perspective view showing vicinity of an ink-jet head shown in FIG. 1.
Figure 3:
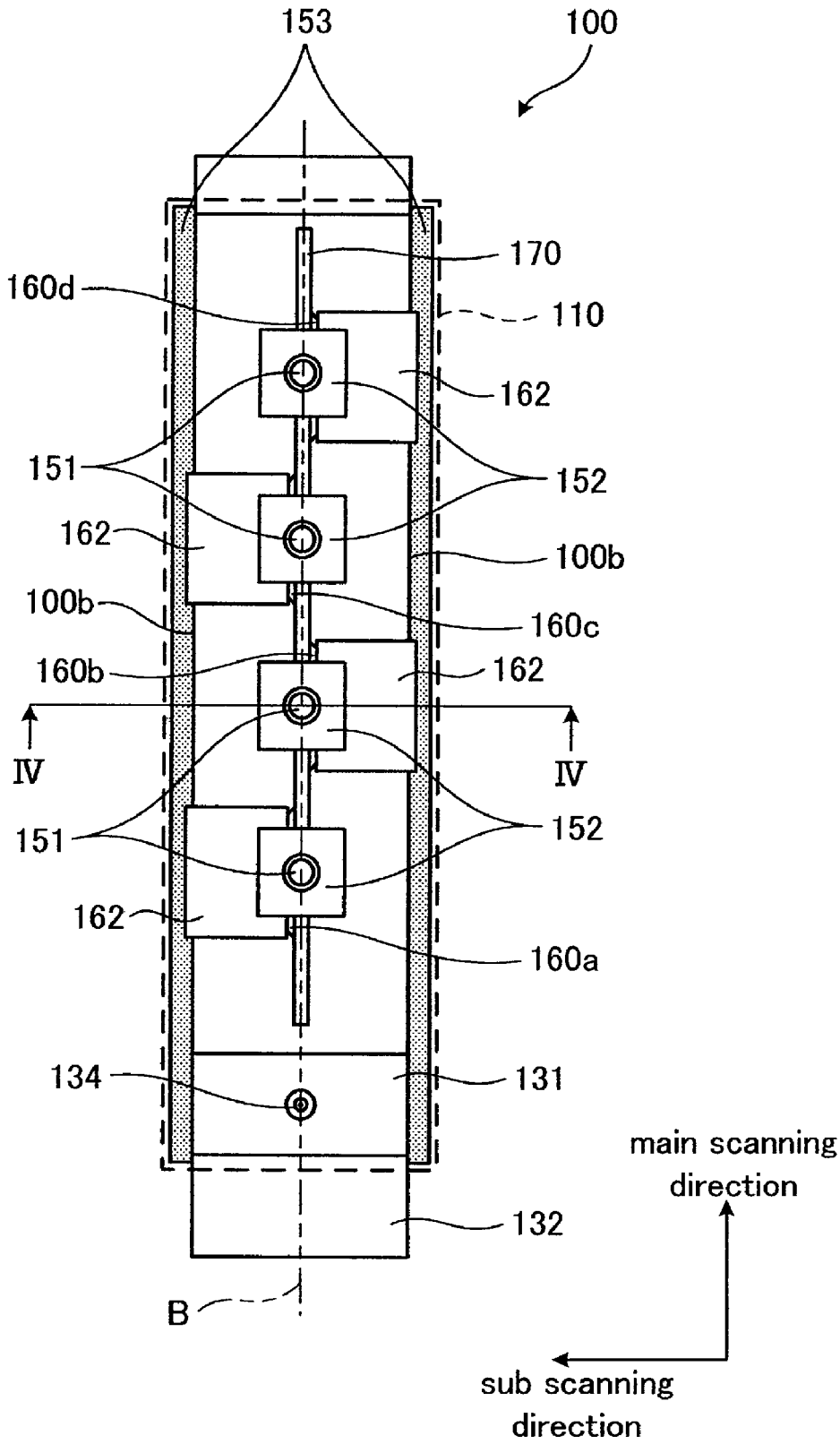
FIG. 3 is a plan view showing vicinity of the ink-jet head shown in FIG. 1.

In the following, the ink-jet head 100 will be described further with reference to FIGS. 2 to 4. In FIGS. 2 and 3, for the purpose of making the drawings more understandable, the head cover 110 is illustrated with broken lines.

In a plan view, as shown in FIG. 3, the ink-jet head 100 has a rectangular shape elongated in the main scanning direction. The ink-jet head 100 includes a head main body 13 and an ink reservoir 130. The head main body 13 has an ejection face 100*a* on which ejection ports 8 are formed. The ink reservoir 130 supplies ink to the head main body 13. The ink reservoir 130 is made up of three layered plates of an upper reservoir plate 131, a reservoir base plate 132, and a lower reservoir plate 133.

Any of the upper reservoir plate 131, the reservoir base plate 132, and the lower reservoir plate 133 has a rectangular shape elongated in the main scanning direction. The three plates 131, 132, and 133 have different lengths with respect to the main scanning direction, but have substantially the same widths with respect to the sub scanning direction. Both ends of the three plates 131, 132, and 133 with respect to the sub scanning direction are almost aligned in a plan view. An upper face of the upper reservoir plate 131 is parallel to both the main scanning direction and the sub scanning direction.

A not-shown ink passage is formed within the three plates 131, 132, and 133. One inflow port of the ink passage is provided on the upper face of the upper reservoir plate 131. Ten outflow ports of the ink passage are provided on a lower face of the lower reservoir plate 133. An ink supply pipe 134 is placed on the inflow port provided on the upper face of the upper reservoir plate 131. The outflow ports provided on the lower face of the lower reservoir plate 133 communicate with later-described openings 5*b* (see FIG. 5) provided on the head main body 13. Accordingly, ink supplied from the ink supply pipe 134 passes through the passage formed within the ink reservoir 130, and flows through the openings 5*b* into the head main body 13.

Side faces 100*b* of the ink-jet head 100 are formed of respective side faces of the head main body 13 and the three plates 131, 132, and 133. The side faces 100*b* extend in both the main scanning direction and the vertical direction.

A control board 170, which functions as an ejection control board, stands on the upper face of the upper reservoir plate 131, at a center of the upper face of the upper reservoir plate 131 with respect to the sub scanning direction. The control board 170 has a substantially rectangular shape elongated in the main scanning direction, and extends in both the vertical direction and the main scanning direction.

Four driver IC chips (Integrated Circuit Chips) 160*a* to 160*d*, which are driver chips, are mounted on the control board 170. The driver IC chips 160*a* to 160*d* have flat shapes that are thin with respect to the sub scanning direction. Each of the driver IC chips 160*a* to 160*d* has two surfaces of inner and outer faces, which are parallel to the control board 170. On the inner face of the two surfaces, wires formed within the driver IC chip 160 are connected to wires on the control board 170.

The four driver IC chips 160*a* to 160*d* are fixed on the control board 170, at the same positions with respect to the vertical direction. The four driver IC chips 160*a* to 160*d* are disposed at regular intervals along the main scanning direction. The driver IC chips 160*a*, 160*b*, 160*c*, and 160*d* are arranged in this order along the main scanning direction sequentially from the one nearest one end of the control board 170. Among the driver IC chips 160*a* to 160*d*, the driver IC chips 160*a* and 160*c* are fixed to one face of the control board 170, while the driver IC chips 160*b* and 160*d* are fixed to the other face of the control board 170. The driver IC chips 160*a* to 160*d* are bare chips all having the same construction.

An Flexible Printed Circuit (FPC) 162, which is a power supply member, has its one end fixed to the outer face of each of the driver IC chips 160*a* to 160*d*. The FPC 162 has, as a base, a flexible and insulating resin sheet on which many wires are formed. An insulating coating is further applied on the wires. The FPCs 162 extend from the respective driver IC chips 160*a* to 160*d*, downward along the control board 170. Near lower ends of the driver IC chips 160*a* to 160*d*, the FPCs 162 extend downward obliquely away from the control board 170. Near upper ends of the side faces 100*b*, the FPCs 162 are bent downward. The FPCs 162 further extend downward therefrom along the side faces 100*b*, to be inserted into a space between the lower reservoir plate 133 and the head main body 13. The other end of the FPC 162 is connected to an actuator unit 21 that is included in the head main body 13.

On the control board 170, various electronic components such as an Integrated Circuit (IC) chip, a capacitor and the like are mounted, and many wires are formed. The electronic components and wires constitute various controller and storage device on the control board 170. The storage device built on the control board 170 stores therein data corresponding to a program for controlling the ink-jet head 100, and data for temporary work.

According to a command sent from the host controller 700, the controller built on the control board 170 transmits to the driver IC chips 160*a* to 160*d* a signal that commands to operate ink ejection in the ink-jet head 100. Based on the signal transmitted from the control board 170, the driver IC chips 160*a* to 160*d* transmit a voltage pulse signal through the FPCs 162 to the actuator units 21 so that an ink ejection operation corresponding to the signal is performed.

The ink-jet head 100 is covered with the head cover 110 so that a portion of the ink-jet head 100 above the head main body 13 is almost covered. The head cover 110 is elongated in the main scanning direction. The head cover 110 has two parallel side walls extending along the main scanning direction, and two parallel side walls extending along the sub scanning direction. Inside of the head cover 110 is a cavity that opens downward (to form an opening 110*a* in FIG. 4). The portion of the ink-jet head 100 above the head main body 13 is received in the cavity.

Four filter cases 152 are placed on an upper face of the head cover 110. The four filter cases 152 are provided at a center of the upper face with respect to the sub scanning direction, and arranged at regular intervals with respect to the main scanning direction. Each filter case 152 has, on its upper face, an air intake 151. The intake 151 and the filter case 152 will be detailed later.

As shown in FIG. 3, with respect to the sub scanning direction, a width of the ink-jet head 100 is smaller than a width of the head cover 110. Thus, in a plan view, a shorter side of the ink-jet head 100 is shorter than a shorter side of the head cover 110. On the other hand, the ink-jet head 100 and the head cover 110 are disposed so that their centers with respect to the sub scanning direction are aligned with each other and in addition so that their longer sides are in parallel with each other. The longer sides of the ink-jet head 100 are disposed symmetrically with respect to a central axis B of the control board 170 in the sub scanning direction, and the longer sides of the head cover 110 are disposed symmetrically with respect to a central axis B of the control board 170 in the sub scanning direction.

Accordingly, two rectangular spaces elongated in the main scanning direction are formed between side faces 100*b* of the ink-jet head 100 (which are in FIG. 3 shown as longer sides of the ink-jet head 100) and inner faces of the side walls of the head cover 110 (which are in FIG. 3 shown as longer sides of the head cover 110). The spaces are formed at symmetrical positions with respect to the central axis B. A filter 153 is disposed near each outflow port 111. The outflow port 111 locates between the side face 100*b* of the ink-jet head 100 (and more specifically a side face of the passage unit 4) and a lower end of the inner face of the side wall of the head cover 110 (and more specifically a lower end of an inner wall face of a later-described thin-wall portion 110*d*). A size of the filter 153 is substantially the same as a size of the outflow port 111. The filter 153 has many micropores that allow air to pass therethrough. When air passes through the micropores, foreign materials contained in the air is caught by the filter 153 and thus removed from the air.

As shown in FIG. 3, each of the four filter cases 152 is disposed at a position on the axis B so as to overlap the driver IC chip 160 with respect to the main scanning direction. The four air intakes 151 are disposed on the central axis B.

Figure 4:
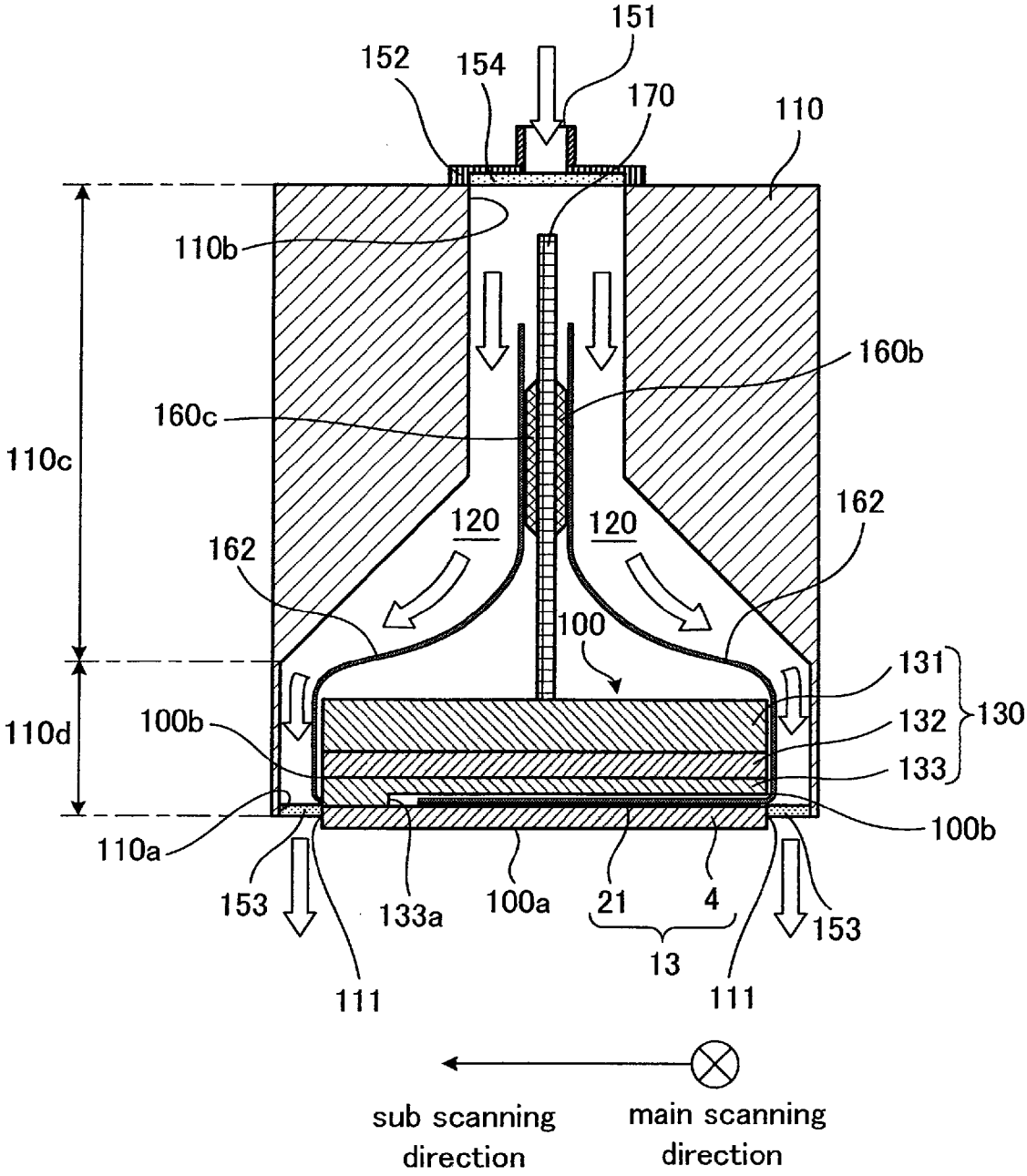
FIG. 4 shows a vertical cross section of vicinity of the ink-jet head, as taken along line IV-IV in FIG. 3.

As shown in FIG. 4, a whole of the ink reservoir 130 is received within the head cover 110. A notch 133*a* is formed on the lower face of the lower reservoir plate 133 which takes a lowest position in the ink reservoir 130. In the lower reservoir plate 133, the notch 133*a* extends from a position a little rightward from a left end in FIG. 4, to a right end. The lower reservoir plate 133 is in contact with the head main body 13, only in its region having no notch 133*a*. As a consequence, a space corresponding to the notch 133*a* is formed between the lower face of the lower reservoir plate 133 and the head main body 13. An opening of the space appears on the side face 100*b*.

The head main body 13 has the passage unit 4 and the actuator units 21. The passage unit 4 has the ejection ports 8 formed on its lower face. The actuator units 21 are bonded to an upper face of the passage unit 4. The actuator units 21 are disposed on the upper face of the passage unit 4 and in the space between the lower face of the lower reservoir plate 133 and the head main body 13. The FPC 162 is connected to an upper face of the actuator unit 21.

The FPC 162 is, in its portion between the driver IC chip 160*a* or 160*c* and the side face 100*b*, bent protrudingly toward the control board 170. Thus, as shown in FIG. 4, the FPC 162 is disposed so as not to wave in the vertical direction and in the sub scanning direction. That is, the FPC 162 is disposed so as not to have overlapping regions in a plan view. As a result, air coming from the intake 151 flows along a surface of the FPC 162 more smoothly than when the FPC 162 is disposed so as to wave in the sub scanning direction (which means when the FPC 162 has some overlapping regions in a plan view).

In a region of the lower face of the lower reservoir plate 133 where no notch 133*a* is formed, outflow ports of the ink passage formed within the ink reservoir 130 are provided. The outflow ports are connected to later-described openings 5*b* that are formed on the upper face of the passage unit 4.

The head cover 110 has two openings of an opening 110*a* that opens downward and an opening 110*b* that opens upward. The opening 110*b* serves as an inflow port having a smaller area than that of the opening 110*a*. As described above, the space is formed between the head cover 110 and the side face 100*b* of the ink-jet head 100. The filter 153 is fixed to the outflow port 111 that locates at a lower end of the space. The filter 153 is disposed lower than the FPC 162 that is inserted into the notch 133*a* of the lower reservoir plate 133.

The filter case 152 is fixed to the upper face of the head cover 110 so as to cover the opening 110*b*. The air intake 151 is fixed to an upper portion of the filter case 152. A filter 154 is contained in the filter case 152. The filter 154 has many micropores that allow air to pass therethrough. When air passes through the micropores, foreign materials contained in the air is caught by the filter 154 and thus removed from the air.

The side wall of the head cover 110 has a thick-wall portion 110*c* and a thin-wall portion 110*d*. The thick-wall portion 110*c* is thickened in the sub scanning direction. The thin-wall portion 110*d* is thinner than the thick-wall portion 110*c* with respect to the sub scanning direction. In an upper region of the thick-wall portion 110*c*, an inner wall face of the head cover 110 is in parallel with the control board 170. In a lower region of the thick-wall portion 110*c*, an inner wall face extends obliquely so as to make a lower portion thereof get more distant from the control board 170. An inner wall face of the thin-wall portion 110*d* is in parallel with the side face 100*b* of the ink-jet head 100. Due to the side wall of the head cover 110 thus constructed, a distance between the inner face of the side wall of the head cover 110 and each of the control board 170, the FPC 162, and the side face 100*b* is smaller than when the head cover 110 does not have the thick-wall portion 110*c*.

A container space 120 is defined by the inner face of the side wall of the head cover 110, the ink-jet head 100, the outflow port 111 that is formed between a lower end of the thin-wall portion 110*d* and the side face 100*b* of the ink-jet head 100, and the opening 110*b* that serves as an inflow port. A portion of the ink-jet head 100 above the passage unit 4, as well as the control board 170, is contained in the container space 120.

Air sent by the air supply unit 500 flows into the air intake 151. The air having flown into the air intake 151 passes through the filter 154, and flows into the container space 120. The air having flown into the container space 120 flows downward along the inner face of the side wall of the head cover 110, a surface of the control board 170, and the surface of the FPC 162. Even after the air passes through the filter 153 and is discharged from the container space 120, the air still flows downward from the filter 153 along the side face 100*b* of the ink-jet head 100, until the air goes from up to down across a plane including the ejection face 100*a*. White arrows shown in FIG. 4 indicate a flow of this air.

Like this, due to an airflow generated by the air supply unit 500, air flows into the container space 120 of the head cover 110, and flows downward along the side face 100*b* of the ink-jet head 100 to then flow out of the container space 120 through the outflow port 111, from up to down across the plane including the ejection face 100*a*. Accordingly, even if a foreign material, which is adhering to a printing paper conveyed to a position under the ink-jet head 100, flies up from the printing paper due to some factor, the foreign material cannot easily approach the ejection face. This less often causes the ejection port 8 to be partially or fully closed with the foreign material. As a result, an image can be formed on the printing paper with excellent reproducibility. In addition, the airflow having flown out through the outflow ports 111 does not include a foreign material, because it was filtered by the two filters 153 and 153. This can prevent a foreign material from adhering to the ejection face 100*a* due to an airflow flowing out of the outflow ports 111. Moreover, the outflow port 111, through which an airflow flows out of the container space 120 formed by the head cover 110, is provided relatively near the ejection face 100*a*. This makes it more difficult that a foreign material adheres to the ejection face, than when an airflow flows outside the head cover. Further, the FPC 162 and the control board 170 are contained within the container space 120 formed by the head cover 110. Accordingly, by an airflow, heat generated in the FPC 162 and the control board 170 can be easily taken away and discharged out of the container space 120. This can prevent overheat of the FPC 162 and the control board 170. Still further, air having flown out through the outflow port 111 blows against a printing paper that is opposed to the ejection face 100*a*. As a result, the printing paper can be prevented from flying up from the conveyor belt 810.

An airflow goes along the side face 100*b* of the ink-jet head 100, out of the container space 120 through the outflow port 111. An airflow thus formed is closer to the ejection face 100*a* than an airflow that flows out through the outflow port 111 at a distance from the side face 100*b*. Therefore, the ejection face 100*a* can be more surely protected from a foreign material.

The opening 110*b* serving as an inflow port overlaps the ejection face 100*a* in a plan view, and is in parallel with the ejection face 100*a*. This can create a smooth airflow allowing air having flown through the opening 110*b* to be discharged from the outflow port 111.

The outflow port 111 is formed between the side face 100*b* of the ink-jet head 100 and a lower end of a portion corresponding to the longer side of the head cover 110. Thus, the outflow port can have a simple construction. In addition, the air outflow ports are provided on both sides extending along the longer sides of the ink-jet head 100. Consequently, a ratio of a total length of the outflow ports 111 to a whole circumferential length of the ink-jet head 100 becomes higher than when the outflow ports are provided only around the shorter sides. As a result, the ejection face 100*a* can be more surely protected from a foreign material.

The container space 120 is defined by the head cover 110, the ink-jet head 100, the inflow port 110*b*, and the outflow port 111, and the filter 153 is disposed near the outflow port 111. Accordingly, it can be prevented that a foreign material is mixed into air that flows out through the outflow port 111.

The outflow ports 111 are provided between the two longer sides of the head cover 110 and the two longer sides of the ink-jet head 100, respectively. Consequently, a ratio of a total length of the outflow ports 111 to a whole circumferential length of the ink-jet head 100 becomes further higher. As a result, the ejection face 100*a* can be more surely protected from a foreign material.

In addition, the FPC 162 has the portion that extends along the side face 100*b* of the ink-jet head 100. This can create a smooth airflow along the side face 100*b* of the ink-jet head 100.

Moreover, since the FPC 162 does not have regions that overlap with respect to a direction perpendicular to the ejection face 100*b*, a more smooth airflow can be created in the container space 120. This can provide good energy efficiency in the air supply unit 500.

Moreover, the driver IC chips 160*a* to 160*d* that generate, based on a signal from the control board 170, a voltage pulse signal which will be supplied to the actuator units 21 is mounted on the FPCs 162. Therefore, ink ejection from the ink-jet head 100 can be done in a desired pattern.

In the ink-jet recording apparatus 1000, the ink-jet head 100 has one pair of side faces 100*b* symmetrical with respect to the central axis B which is an imaginary line. The two pairs of FPCs 162 respectively have portions extending along the one pair of side faces 100*b*. The two pairs of driver IC chips 160*a* to 160*d* are electrically connected to the wires of the two pairs of FPCs 162, respectively. As a result, adhering of a foreign material to the ejection face 100*a* can be more prevented, as compared with when air flows out along one side face 100*b* alone.

The inflow port 110*b* is provided at such a position that the control board 170 is sandwiched between the inflow port 110*b* and the ink-jet head 100. Because of the control board 170, air having flown into the inflow port 110*b* is branched into two flows toward the respective side faces 100*b*. This can create a smooth airflow that go toward the outflow ports 111 provided for the respective side faces 100*b*.

Further, the FPC 162 has a portion bent protrudingly toward the control board 170 on which the driver IC chip is mounted. Accordingly, a smooth airflow going along the bent portion of the FPC 162 toward the outflow port 111 can be created.

In addition, various advantageous effects as described below can be obtained in this embodiment. The air intake 151 and the opening 110*b* of the head cover 110 are disposed near a center of the head cover 110 with respect to the sub scanning direction. Accordingly, air is likely to flow uniformly on right and left sides with respect to the sub scanning direction.

Since the filters 153 and 154 are provided at boundaries between the container space 120 and the exterior of the head cover 110, it can be surely prevented that a foreign material enters the container space 120.

A distance between the inner face of the side wall of the head cover 110 and each of the control board 170, the surface of the FPC 162, and the side face 100*b* is small, and therefore an air passage within the container space 120 has a limited width. As a result, an airflow going from the air intake 151 toward the filter 153 can be created smoothly.

The air supply unit 500 including the ionizer 500*b* supplies air that contains a charged particle. Therefore, a foreign material adhering to a printing paper is captured by charged particles and thus removed from the printing paper. Then, the foreign material together with an airflow is discharged out of the container space 120 through the outflow port 111. Consequently, it becomes more difficult that a foreign material adheres to the ejection face 100*a*.

[Head Main Body]

The head main body 13 will be described further with reference to FIGS. 5 and 6. The head main body 13 has the passage unit 4 and four actuator units 21 bonded onto the passage unit 4.

The passage unit 4 has upper and lower faces extending in parallel with both of the main scanning direction and the sub scanning direction. The lower face represents the ejection face 100*a*. The actuator unit 21, which has a trapezoidal shape, is bonded to the upper face of the passage unit 4 in such a manner that a pair of parallel opposed sides of the trapezoidal shape extend in parallel with the lengthwise direction of the passage unit 4. Assuming two lines that extend in parallel with the lengthwise direction of the passage unit 4, two actuator units 21 are arranged along each of the two lines. That is, a total of four actuator units 21 are arranged on the passage unit 4, in a zigzag pattern as a whole. Every neighboring actuator units 21 on the passage unit 4 have their oblique sides overlap each other with respect to the main scanning direction.

Manifold channels 5 which form a part of ink passages are formed within the passage unit 4. Openings 5*b* of the manifold channels 5 are formed on the upper face of the passage unit 4. A total number of the openings 5*b* is ten, and five of them are formed along each of the two lines (imaginary lines) extending in parallel with the lengthwise direction of the passage unit 4. The openings 5*b* are positioned so as to keep away from where the four actuator units 21 are disposed. Ink is supplied from a not-shown ink tank through the openings 5*b* into the manifold channels 5.

Figure 5:
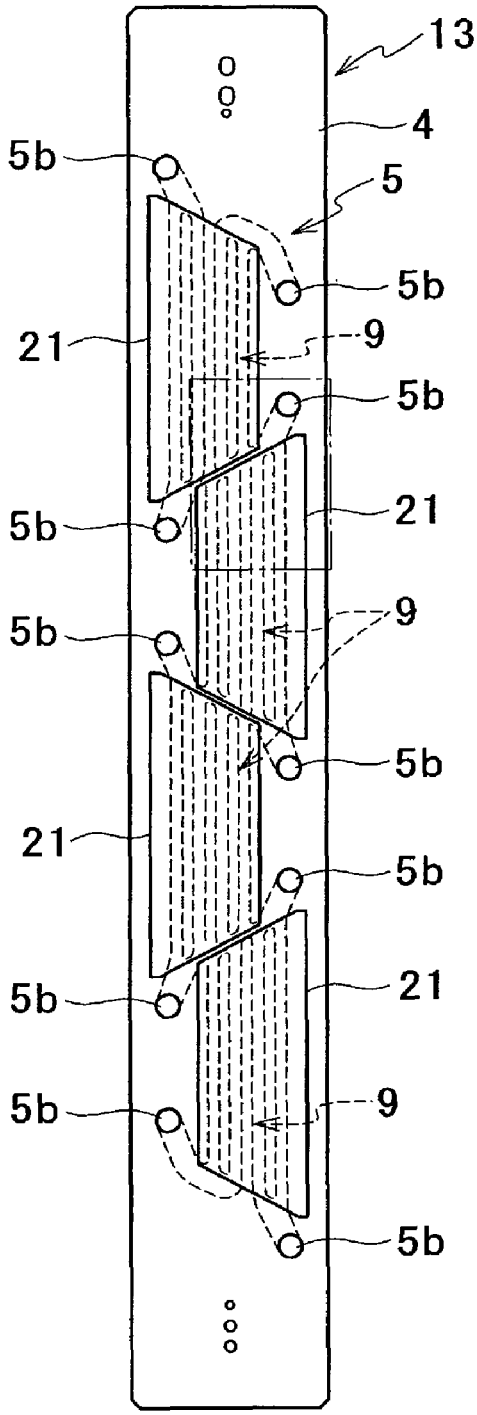
FIG. 5 is a plan view of a head main body shown in FIG. 1.
Figure 6:
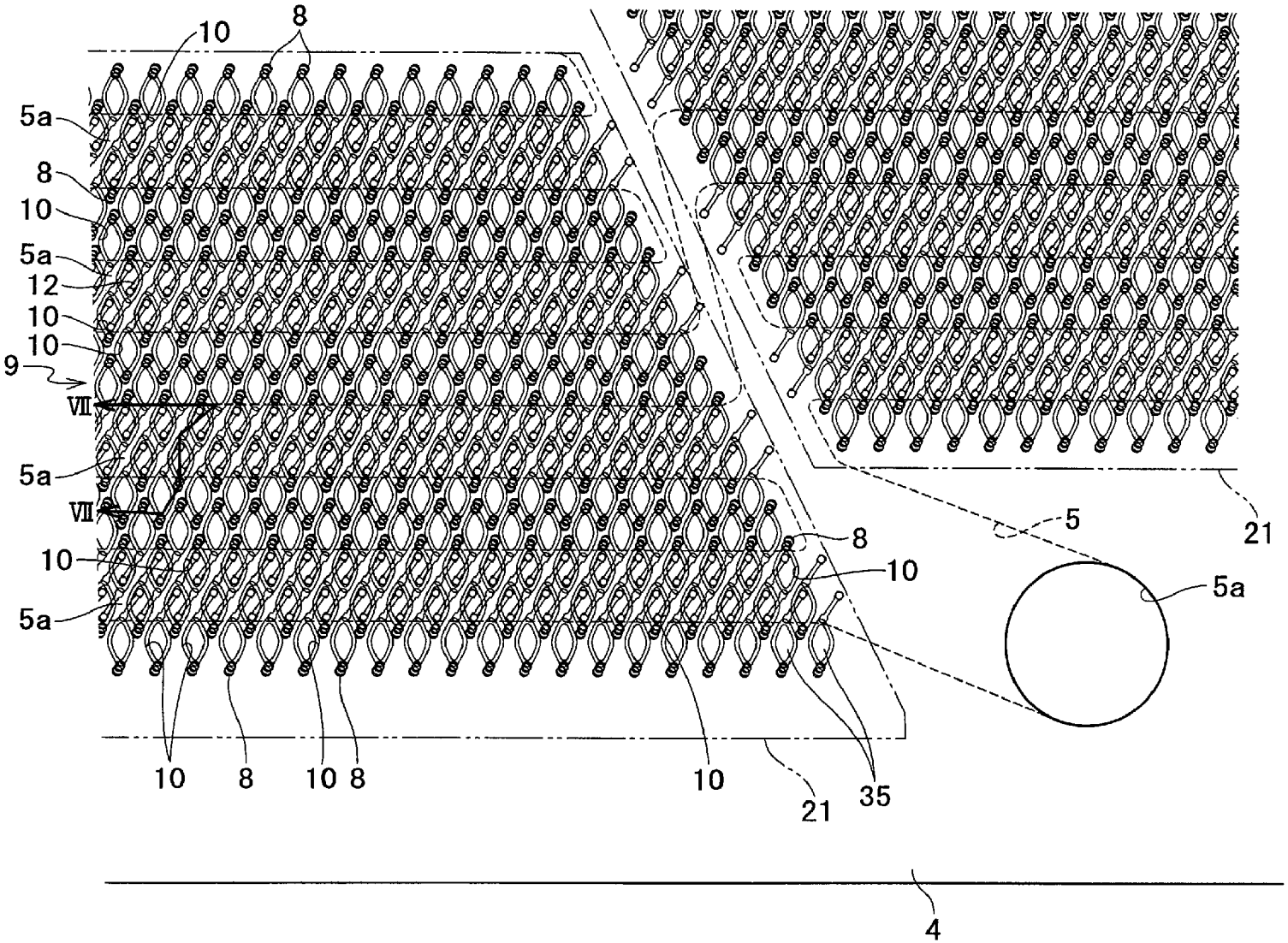
FIG. 6 shows on an enlarged scale a region enclosed with an alternate long and short dash line in FIG. 5.

FIG. 6 shows on an enlarged scale a region enclosed with an alternate long and short dash line in FIG. 5. In FIG. 6, for convenience of explanation, the actuator units 21 are illustrated with alternate long and two short dashes lines, while apertures 12 and ejection ports 8 are illustrated with solid lines although they are formed within or on the lower face of the passage unit 4 and therefore should actually be illustrated with broken lines.

The manifold channel 5 formed within the passage unit 4 branches off into several sub manifold channels 5*a*.

The passage unit 4 has a pressure chamber group 9 that includes pressure chambers 10 formed in a matrix. The pressure chamber 10 is a hollow region having, in a plan view, a substantially rhombic shape with rounded corners. The pressure chamber 10 is formed so as to open on the upper face of the passage unit 4. On the upper face of the passage unit 4, the pressure chambers 10 are arranged substantially throughout a whole of a region opposed to the actuator unit 21. Consequently, an area occupied by each pressure chamber group 9, which is made up of the pressure chambers 10, has substantially the same size as that of the actuator unit 21. The actuator unit 21 is bonded to the upper face of the passage unit 4, thereby closing openings of the respective pressure chambers 10.

On the upper face of the actuator unit 21, individual electrodes 35 are formed at positions opposed to the respective pressure chambers 10. A shape of the individual electrode 35 is substantially similar to but a little smaller than that of the pressure chamber 10. The individual electrode 35 is disposed on the upper face of the actuator unit 21 so as to fall within a region opposed to the pressure chamber 10.

Many apertures 12, which function as throttles, are formed within the passage unit 4. The apertures 12 are disposed in a region opposed to the pressure chamber group 9. In this embodiment, the aperture 12 extends in one direction parallel to a horizontal plane.

Formed within the passage unit 4 are communication holes that make communication among the respective apertures 12, the respective pressure chambers 10, and the respective ejection ports 8. The communication holes communicate with each other, to form individual ink passages 32 (see FIG. 7). Each individual ink passage 32 communicates with a sub manifold channel 5*a*. Ink supplied to the manifold channel 5 is then supplied through the sub manifold channels 5*a* to the respective individual ink passages 32, and then ejected from the ejection ports 8.

[Individual Ink Passages]

Figure 7:
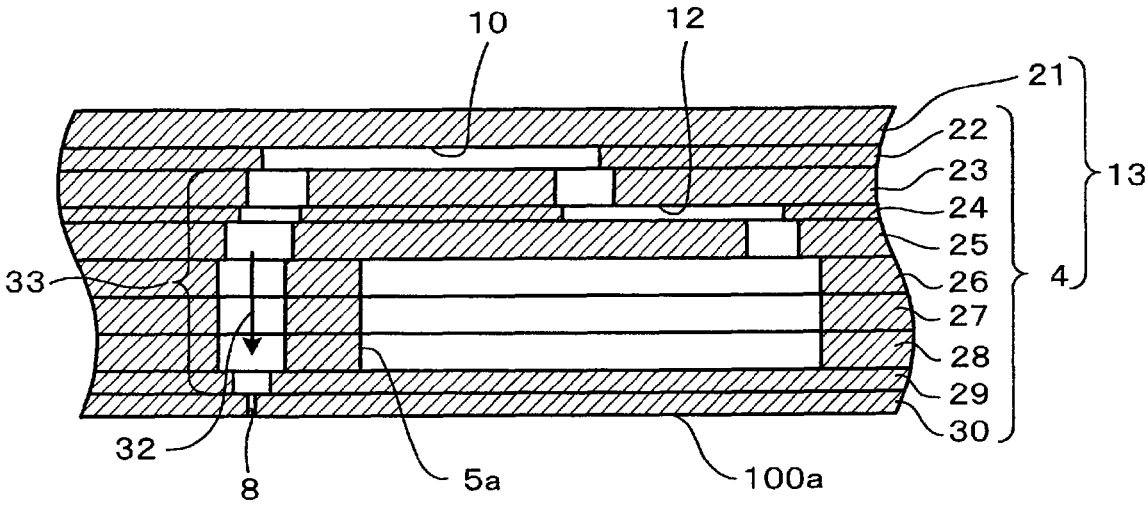
FIG. 7 shows a vertical cross section of the head main body, as taken along line VII-VII in FIG. 6.

A cross-sectional structure of the head main body 13 will be described further with reference to FIG. 7. The passage unit 4 included in the head main body 13 has a layered structure laminated with plates. The plates are, from the upper face of the passage unit 4, a cavity plate 22, a base plate 23, an aperture plate 24, a supply plate 25, manifold plates 26, 27, 28, a cover plate 29, and a nozzle plate 30. Many communication holes are formed in these plates. The plate are positioned and laminated with each other in such a manner that the communication holes communicate with each other so as to form individual ink passages 32 and sub manifold channels 5*a*.

[Actuator Unit]

Figure 8:
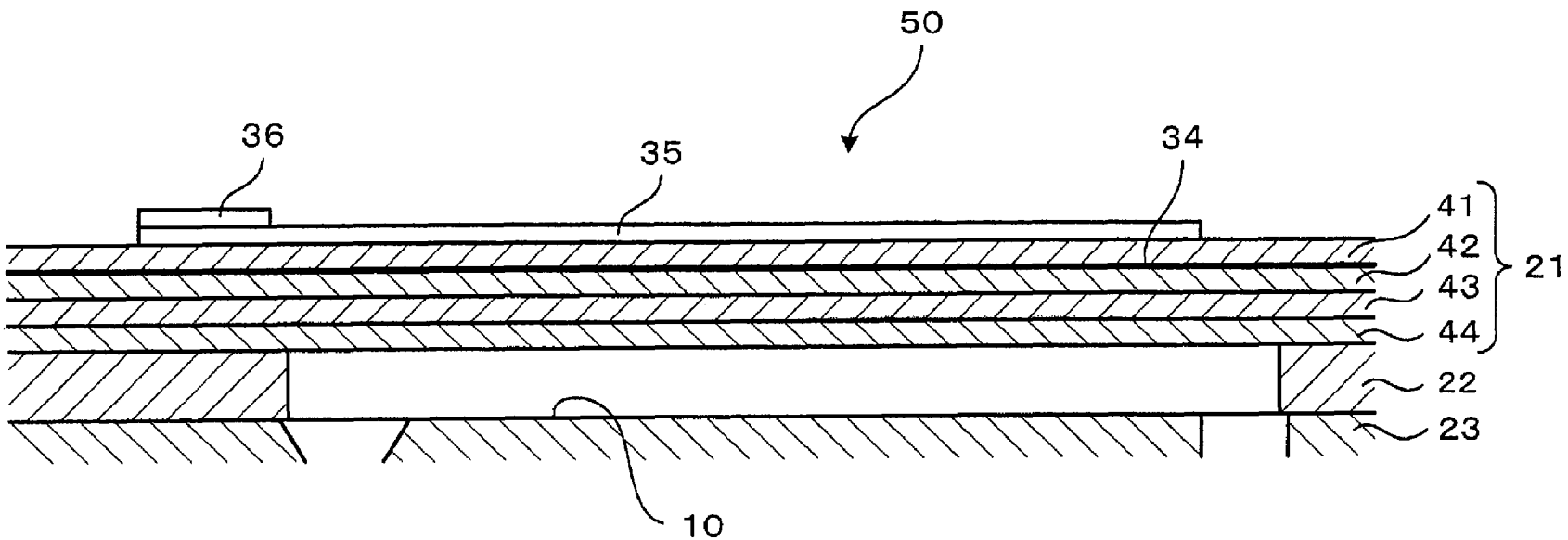
FIG. 8 shows on an enlarged scale a part around an actuator unit shown in FIG. 7.

As shown in FIG. 8, the actuator unit 21 has a layered structure made up of four piezoelectric layers 41, 42, 43 and 44. Each of the piezoelectric layers 41 to 44 has a thickness of approximately 15 μm. The actuator unit 21 as a whole has a thickness of approximately 60 μm. Any of the piezoelectric layers 41 to 44 extends over pressure chambers 10 (see FIG. 6). The piezoelectric layers 41 to 44 are made of a lead zirconate titanate (PZT)-base ceramic material having ferroelectricity.

The actuator unit 21 has individual electrodes 35 and a common electrode 34 that are made of an Ag—Pd-base metal material. As described above, the individual electrodes 35 are disposed on the upper face of the actuator unit 21, at positions opposed to the respective pressure chambers 10. One end of the individual electrode 35 extends out beyond a region opposed to the pressure chamber 10, and provided with a land 36. The land 36 is made for example of gold including glass frits, has a thickness of approximately 15 μm, and has a protruding shape. The land 36 is electrically bonded to a not-shown contact that is formed in the FPC 162.

The common electrode 34 is interposed between the piezoelectric layer 41 and the piezoelectric layer 42, substantially throughout an entire face in a plane direction. That is, the common electrode 34 extends over all of pressure chambers 10 that exist in the region opposed to the actuator unit 21. The common electrode 34 has a thickness of approximately 2 μm. The common electrode 34 is grounded in a not-shown region, and held at the ground potential.

As shown in FIG. 8, the two electrodes are disposed so as to sandwich only the uppermost piezoelectric layer 41 therebetween. A region of the piezoelectric layer sandwiched between each individual electrode 35 and the common electrode 34 is referred to as an active portion. In the actuator unit 21 of this embodiment, only the uppermost piezoelectric layer 41 includes active portions, and the other piezoelectric layers 42 to 44 include no active portion. That is, the actuator unit 21 has a so-called unimorph type structure.

When a predetermined voltage pulse is selectively supplied to an individual electrode 35, pressure is applied to ink contained in a pressure chamber 10 that corresponds to this individual electrode 35. As a result, through an individual ink passage 32, ink is ejected from a corresponding ejection port 8.

Second Embodiment

In the following, an ink-jet recording apparatus according to a second embodiment of the present invention will be described with reference to FIGS. 9 and 10. Except for an ink-jet head, a construction of this embodiment is the same as the construction of the first embodiment. An ink-jet head 200 included in the apparatus of this embodiment has many members in common with the ink-jet head 100 of the first embodiment. Therefore, in the following, the same members will be denoted by the same reference numbers, and specific descriptions thereof will be omitted.

Figure 9:
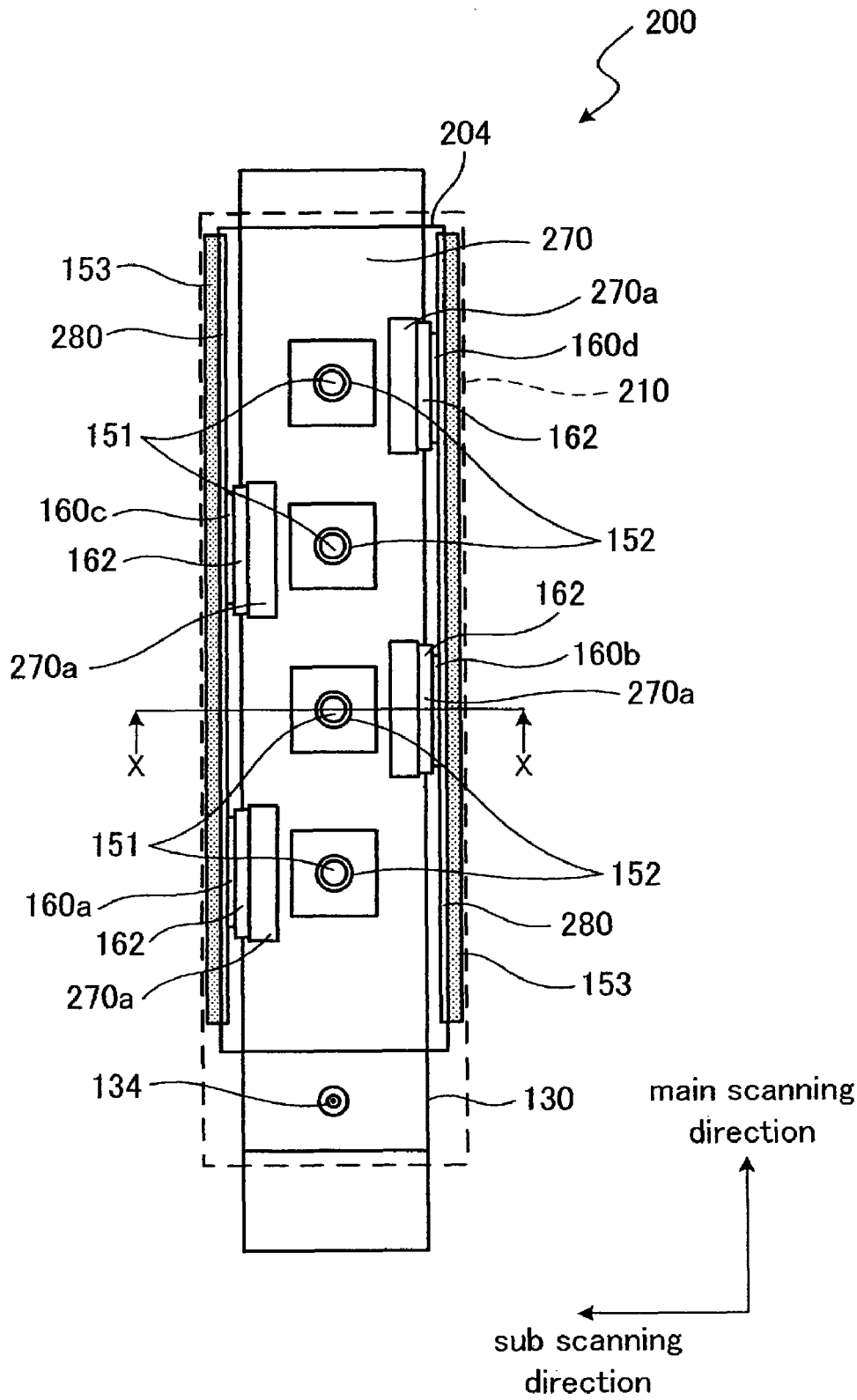
FIG. 9 is a plan view showing vicinity of an ink-jet head according to another embodiment of the present invention.

In the ink-jet head 200, as shown in FIG. 9, a width of a passage unit 204 with respect to the sub scanning direction is larger than that of the ink reservoir 130. In a plan view, both ends of the passage unit 204 with respect to the sub scanning direction do not overlap the ink reservoir 130.

A control board 270 has a rectangular plate-like shape elongated in the main scanning direction. As shown in FIG. 10, the control board 270 is disposed on the ink reservoir 130 and in parallel to the ejection face. Connectors 270*a* are placed on the control board 270. A not-shown contact of the connector 270*a* is connected to a wire formed on the control board 270.

Heat sinks 280 are fixed to both ends of the upper face of the passage unit 204 with respect to the sub scanning direction. The heat sink 280, which is made of a metal material such as aluminum, is a rectangular flat plate elongated in the main scanning direction. A thermal conductivity of the heat sink 280 is higher than that of the base of the FPC 162. The heat sinks 280 stand on the passage unit 204 with its thickness direction being along the sub scanning direction. As shown in FIG. 10, the heat sinks 280 vertically extend from the upper face of the passage unit 204 up to substantially the same level as the control board 270.

One end of the FPC 162 is connected to the connector 270*a*. The FPC 162 extends out from the connector 270*a* toward the passage unit 204 disposed therebelow. The driver IC chips 160*a* to 160*d* are mounted on the surfaces of the FPCs 162, in regions between the respective connectors 270*a* and the passage unit 204. The driver IC chips 160*a* to 160*d* are disposed in such a manner that they are sandwiched between the FPCs 162 and the heat sinks 280. Inner side faces of the driver IC chips 160*a* to 160*d* are fixed to the FPCs 162, while outer side faces thereof are in contact with the heat sinks 280. Since the driver IC chips 160*a* to 160*d* are in contact with the heat sinks 280 whose thermal conductivity is higher than that of the bases of the FPCs 162, heat generated in the driver IC chips 160*a* to 160*d* can be efficiently dissipated through the heat sinks 280.

A head cover 210 has a substantially rectangular parallelepiped shape in which a cavity is formed. The cavity opens on a substantially entire lower face of the head cover. The head cover 210 is elongated in the main scanning direction. The head cover 110 covers most of a portion above the head main body 13. Two slits 210*a* serving as outflow ports are formed at a lower portion of the head cover 210. Referring to FIG. 9, the filter 153 is disposed between the heat sink 280 and the head cover 210, so as to cover the slit 210*a*. An opening 210*b* serving as an inflow port is formed at an upper portion of the head cover 210.

A container region 220, which is defined by an inner face of the head cover 210, the ink-jet head 200, openings 210*a*, and the opening 210*b*, is provided within the head cover 210. The container region 220 is made up mainly of two spaces α and β. The space α is a space between an upper face of the head cover 210 and the control board 270. The space β is a space between the heat sink 280 and an inner face of a side wall of the head cover 210.

Figure 10:
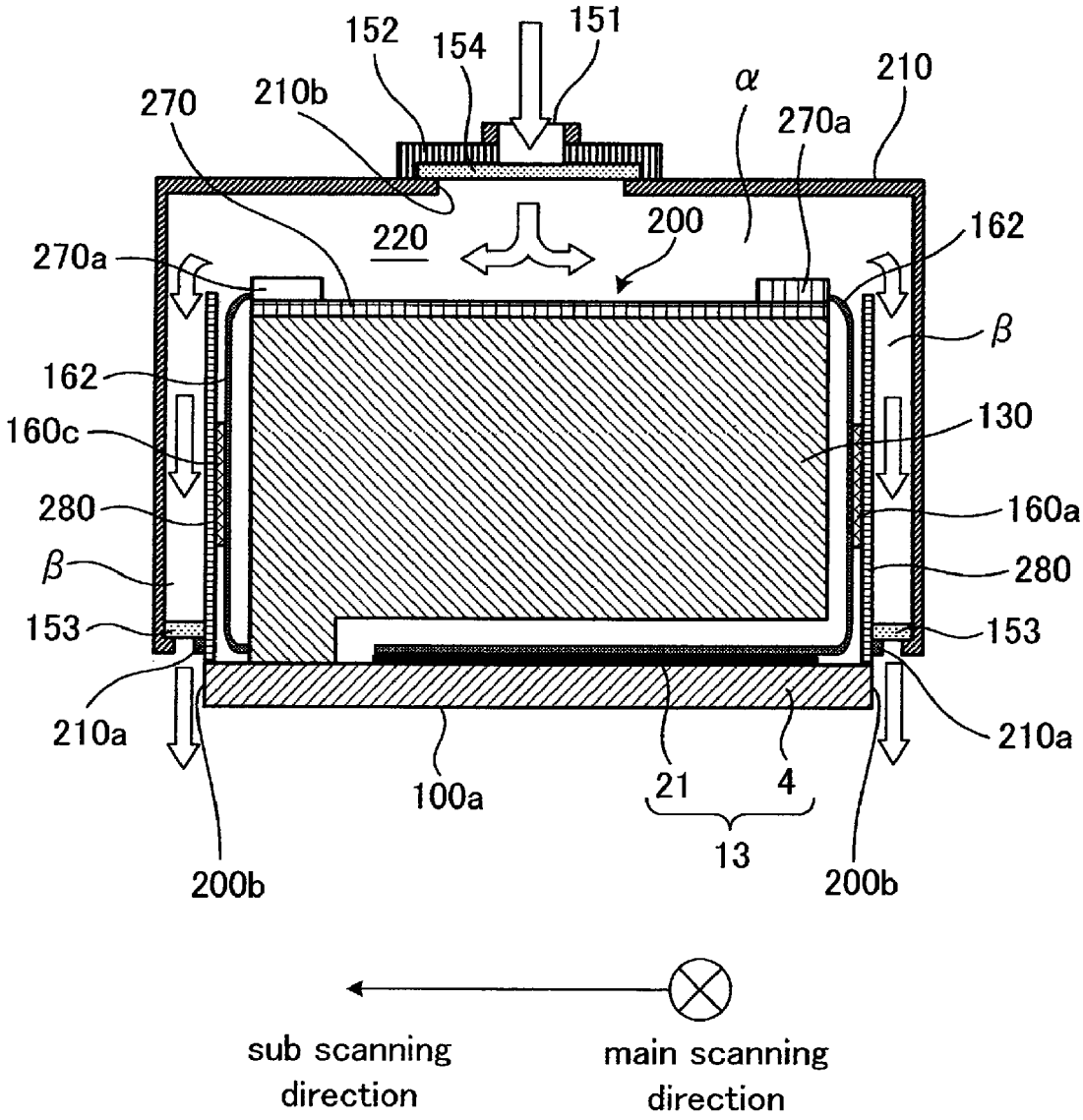
FIG. 10 shows a vertical cross section of vicinity of the ink-jet head, as taken along line X-X in FIG. 9.

In the space α, air having flown from the air intake 151 through the filter 154 into the container region 220 diverges in both directions parallel to the sub scanning direction (which means a horizontal direction in FIG. 10). Thus, an airflow going along the control board 270 toward the side walls of the head cover 210 is created. When the air eventually reaches the side walls of the head cover 210, the air then flows in the space β downward along the side wall. Even after the air passes through the filter 153 and is discharged from the container region 220, the air still flows downward from the filter 153 along the side face 200*b* of the ink-jet head 200 (and more specifically a side face of the passage unit in this embodiment), until the air goes from up to down across a plane including the ejection face 100*a*. White arrows shown in FIG. 10 indicate a flow of this air.

As described above, the control board 270 is parallel to the ejection face 100*a*, and a pair of heat sinks 280 extend in the vertical direction from substantially the same level as the control board 270, to the upper face of the passage unit 204. This can provide a smooth airflow that goes from the air intake 151 to the slits 210*a* formed at the lower portion of the head cover 210. In addition, since an airflow along the heat sinks 280 is created, heat generated in the driver IC chips 160*a* to 160*d* is more efficiently dissipated to the air through the heat sinks 280.

As shown in FIG. 10, the heat sink 280 is in contact with an end of the passage unit 204. This narrows an air passage in the space β formed between the heat sink 280 and the side wall of the head cover 210. As a result, air flows efficiently through the passage, and at the same time heat of the driver IC chips 160*a* to 160*d* can be discharged efficiently.

Third Embodiment

In the following, an ink-jet recording apparatus according to a third embodiment of the present invention will be described. Except for an ink-jet head, a construction of this embodiment is the same as the construction of the first embodiment. An ink-jet head 300 included in the apparatus of this embodiment has many members in common with the ink-jet head 100 of the first embodiment. Therefore, in the following, the same members will be denoted by the same reference numbers, and specific descriptions thereof will be omitted.

Figure 11:
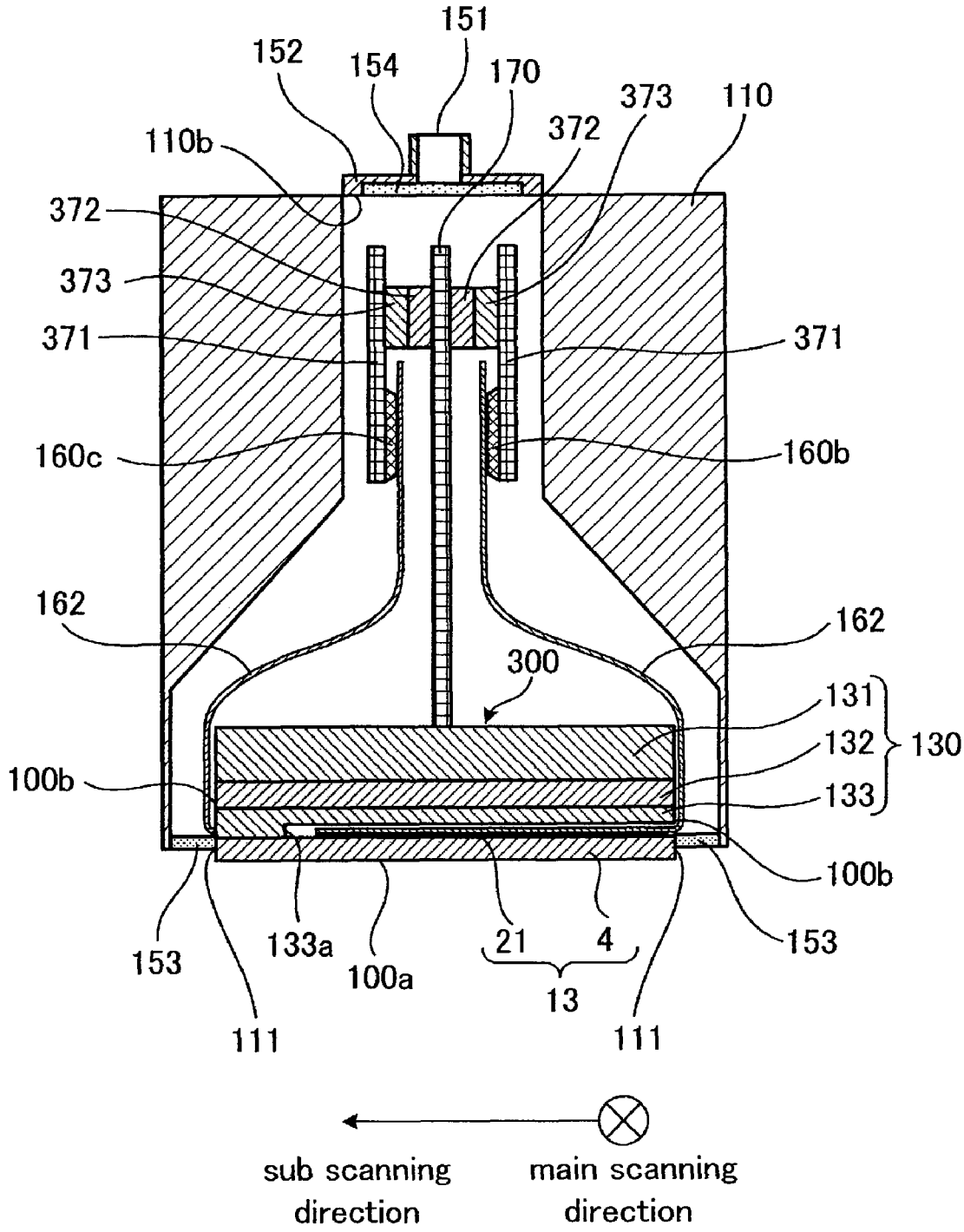
FIG. 11 shows a vertical cross section of vicinity of an ink-jet head according to still another embodiment of the present invention.

As shown in FIG. 11, the ink-jet head 300 includes not only the control board 170 but also four sub boards 371. FIG. 11 illustrates two of the four sub boards 371. The sub boards 371 are disposed along an up-and-down direction in FIG. 11. The FPC 162 is fixed to each of the four sub boards 371, and each sub board 371 is disposed near a distal end of the FPC 162. Two of the four sub boards 371 face one surface of the control board 170, and the other two sub boards 371 face the other surface of the control board 170. All the sub boards 371 are at the same distance from the control board 170.

A connector 373 is fixed to each sub board 371, at an upper portion of an inner side face of the sub board 371 which faces the control board 170. In addition, a connector 372 which makes a pair with the connector 373 is fixed to the surface of the control board 170, at a position opposed to the connector 373. Wires on the control board 170 and wires on the sub board 371 are electrically connected through the connectors 372 and 373. At lower portions of the inner side faces of the four sub boards 371, the driver IC chips 160*a* to 160*d* are fixed and electrically connected to the wires formed on the sub boards 371. The FPCs 162 are electrically connected to inner side faces of the driver IC chips 160*a* to 160*d* which face the control board 170.

In the ink-jet head 300 thus constructed, air having flown from the air intake 151 flows downward through a space between the sub board 371 and the inner face of the side wall of the head cover 110. Since the sub board 371 which is a flat plate has its surface extending in an up-and-down direction, a smooth airflow flowing from up to down can be created within the head cover 110. In addition, due to presence of the sub board 371, an air passage becomes narrower than in the first embodiment. As a result, air flows efficiently, and heat of the driver IC chips 160*a* to 160*d* can be discharged efficiently.

[Modifications]

Although in the above-described embodiments two filters 153 and 154 are used, it may be possible to use only one of them. A filter may be disposed either at a position distant from the head cover and within the container space. The ink-jet recording apparatus 1000 employs a so-called line-head system. That is, the ink-jet heads 100 are immovable. However, the present invention may be applicable to an ink-jet recording apparatus that performs printing with a head moving in the main scanning direction.

In the above-described embodiments, an actuator unit using a piezoelectric material is adopted for ink ejection. However, the present invention may be applied to an ink-jet recording apparatus that adopts another ink ejection method such as a thermal method.

In the above-described embodiments, the air supply unit 500 is placed on the upper face of the head cover 110 or 210. However, it may be placed anywhere else, as long as it is a means that generates an airflow allowing air to flow out from the lower face of the head cover 110 or 210. For example, it may be possible that the air supply unit is placed within the head cover, or alternatively that the air supply unit is placed at a distance from the head cover and supplies air into the head cover by means of an air pipe. Further alternatively, it may also be possible that the air supply unit is placed at an air outflow port on an outer surface of the head cover and applies negative pressure to air existing around the outflow port so that air existing within the head cover is sucked downward.

In the above-described embodiments, the air supply unit 500 supplies air into all the head covers included in the ink-jet recording apparatus 1000. However, the ink-jet recording apparatus may supply air into only a part of the head covers. In such a case, it is preferable to supply air into, among head covers of respective ink-jet heads, at least a head cover of the most upstream ink-jet head with respect to the conveyance direction. This allows air to blow against a printing paper at the most upstream point with respect to the conveyance direction. As a result, a foreign material adhering to the printing paper is prevented from affecting the downstream ink-jet heads.

Preferably, even while no printing paper is being conveyed, the air supply unit 500 is driven to supply air into the head cover. For example, it is preferable that the air supply unit is kept driven all the while the ink-jet recording apparatus is being powered up. Thereby, the ejection face can be more surely kept clean.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet recording apparatus comprising:

an ink-jet head comprising an ejection face on which an ejection port that ejects ink is formed, a side face extending along a direction crossing the ejection face, and an ejection energy applier that applies ejection energy to ink thereby making ink ejected from the ejection port;

an ejection control board that is fixed to the ink-jet head and electrically connected to the ejection energy applier;

a head cover that is fixed to the ink-jet head so as to expose out the ejection face, and forms a container space that contains therein the ejection control board;

an inflow port through which air passes into the container space;

an outflow port through which air passes out of the container space;

a filter that filters air; and an airflow generator that generates an airflow going into the container space through the inflow port and out of the container space through the outflow port, wherein the head cover comprises an open plane formed through an end thereof, through which open plane the ejection face of the ink-jet head is exposed to the outside of the head cover, wherein the outflow port is formed on the open plane between the ink-jet head and the head cover, wherein an airflow filtered by the filter goes out of the container space through the outflow port in a direction perpendicular to the ejection face and across a plane including the ejection face, and wherein:

the container space is defined by the head cover, the ink-jet head, the inflow port, and the outflow port; and the filter is positioned near the outflow port.

2. The ink-jet recording apparatus according to claim 1, wherein-an airflow goes out of the container space through the outflow port and along the side face of the ink-jet head.

3. The ink-jet recording apparatus according to claim 1, wherein the inflow port overlaps the ejection face in a plan view and extends in parallel with the ejection face.

4. The ink-jet recording apparatus according to claim 1, wherein:

the ink-jet head and the head cover are rectangular in a plan view, and a shorter side of the head cover is longer than a shorter side of the ink-jet head while their longer sides are parallel to each other; and the outflow port is formed between the side face of the ink-jet head and a lower end of a portion corresponding to the longer side of the head cover.

5. The ink-jet recording apparatus according to claim 4, wherein at least one outflow port is disposed between each of the two longer sides of the head cover and each of the two longer sides of the ink-jet head.

6. The ink-jet recording apparatus according to claim 5, wherein:

the ink-jet head comprises a passage unit and an ink reservoir that supplies ink to the passage unit, the passage unit comprising the ejection energy applier adheres thereto and comprising therein an ink passage at one end of which the ejection port is formed, the ink reservoir mounted on the passage unit in such a manner that the ejection energy applier is sandwiched between the ink reservoir and the passage unit;

the ink-jet recording apparatus further comprises a power supply member including a wire and a flexible base that supports the wire, the wire being electrically connected to both of the ejection energy applier and the ejection control board; and the power supply member has a portion extending along the side face of the ink-jet head.

7. The ink-jet recording apparatus according to claim 6, wherein the power supply member has no overlapping regions arranged along a direction perpendicular to the ejection face.

8. The ink-jet recording apparatus according to claim 6, further comprising a driver IC chip that is mounted on the power supply member and generates, based on a signal from the ejection control board, a voltage pulse signal which will be supplied to the ejection energy applier.

9. The ink-jet recording apparatus according to claim 6, wherein:

the ink-jet head has a pair of the side faces positioned symmetrically with respect to one imaginary line extending along the ejection face;

the ink-jet recording apparatus includes:

a pair of the power supply members each having a portion extending along each of the pair of the side faces; and a pair of the driver IC chips each electrically connected to the wire of each of the pair of the power supply members.

10. The ink-jet recording apparatus according to claim 9, wherein the inflow port is disposed at such a position that the ejection control board is sandwiched between the inflow port and the ink-jet head.

11. The ink-jet recording apparatus according to claim 10, further comprising a pair of heat sinks each disposed between each side face of the head cover and the ink-jet head, the heat sinks having a higher thermal conductivity than that of the base of the power supply member, wherein each of the pair of heat sinks is in contact with each of the pair of driver IC chips.

12. The ink-jet recording apparatus according to claim 11, wherein:

the ejection control board is parallel to the ejection face; and each of the pair of heat sinks has a plate-like shape extending from substantially the same level as the ejection control board, in the direction crossing the ejection face.

13. The ink-jet recording apparatus according to claim 12, wherein each of the pair of heat sinks is in contact with an end of the ink-jet head.

14. The ink-jet recording apparatus according to claim 10, wherein: the ejection control board extends along the direction crossing the ejection face; each of the pair of the driver IC chips is mounted on each face of the ejection control board; and the power supply member has a portion bent protrudingly toward the ejection control board.

15. The ink-jet recording apparatus according to claim 1, further comprising a charged particle generator that feeds a charged particle into air which will flow out through the outflow port.

* * * * *